United States Patent [19]

Osaka et al.

[11] 4,016,727

[45] Apr. 12, 1977

[54] DRAIN TROUGH MEMBER AND ITS CONNECTOR

[75] Inventors: Tomikazu Osaka; Morihisa Otsuka, both of Fukui, Japan

[73] Assignee: Fukuvi Chemical Industry Co., Ltd., Japan

[22] Filed: Mar. 4, 1975

[21] Appl. No.: 555,247

[30] Foreign Application Priority Data

Mar. 18, 1974 Japan ..... 49-031481[U]

[52] U.S. Cl. ..... 61/11; 138/99; 138/111; 138/115; 138/112; 138/178

[51] Int. Cl.[2] ..... E02B 11/00

[58] Field of Search ..... 138/106, 111, 115, 155, 138/158, 117, 161, 163, 99, 178, 105, 103; 285/373, 419, 420, DIG. 22; 24/81 PE; 248/159, 68 R, 68 CB; 46/28, 29; 61/10

[56] References Cited

UNITED STATES PATENTS

| | | | |
|---|---|---|---|
| 89,630 | /1869 | Carlton | 138/103 X |
| 724,909 | 4/1903 | Maxwell | 138/115 |
| 870,356 | 11/1907 | Gammeter | 138/106 |
| 1,141,067 | 5/1915 | Lloyd | 138/111 |
| 1,350,229 | 8/1920 | Lee | 138/103 X |
| 2,196,708 | 4/1940 | Reid | 138/115 |

FOREIGN PATENTS OR APPLICATIONS

| | | | |
|---|---|---|---|
| 917,812 | 1/1947 | France | 138/158 |
| 289,189 | 1/1914 | Germany | 138/156 |
| 30,708 | 12/1898 | United Kingdom | 138/111 |
| 19,486 | 8/1913 | United Kingdom | 138/111 |
| 474,212 | 10/1937 | United Kingdom | 138/111 |

*Primary Examiner*—Richard E. Aegerter
*Assistant Examiner*—James E. Bryant, III
*Attorney, Agent, or Firm*—Robert E. Burns; Emmanuel J. Lobato; Bruce L. Adams

[57] ABSTRACT

A drain trough having longitudinally lined plastic round pipes and plastic connectors for connecting the pipes to each other in order to form a long drain trough. The plastic pipes each has slits longitudinally and intermittently extending and formed in the peripheral wall of the pipe. The inner space of the pipe has a partition wall of various shapes, which wall extending along the length of the pipe so as to divide the space into two, three or four compartments, through which drain water flows. The drain trough is slantly buried in the ground or track and field.

1 Claim, 6 Drawing Figures

DRAIN TROUGH MEMBER AND ITS CONNECTOR

BACKGROUND OF THE INVENTION

This invention relates to a drainage work and more particularly to a drain trough and its connector adapted to use in the drainage work draining off rainwater or sewage.

Many prior art methods and devices have been proposed to collect and drain off rainwater of sewage. According to the prior art, bamboo pipes, vinyl pipes and perforated concrete pipes have been used as a drain trough adapted to be buried in a flat piece of land, a track and field, an airport, a road, a retaining wall, a sloping foundation in order to collect water falling onto them and penetrating through sand, stone and earth and drain various kinds of land mentioned above. The conventional drain pipes of the various kinds have not functioned satisfactorily, because the openings of them through which water enter into the trough are easily clogged by sand and earth. Further, respective drain pipe members are connected by means of a bulky cylindrical member extending all around the circumference of the pipe members are pre-connected on the ground level and the long drain pipe is buried in the foundation.

SUMMARY OF THE INVENTION

Accordingly, a main object of this invention is to provide a drain trough constructed by plastic round pipes and plastic connectors for them.

Other objects of the invention will be more clearly apparent from the description and claims hereinafter.

BRIEF DESCRIPTION OF THE DRAWINGS In the drawings:

FIGS. 1, 2 and 3 show sectional views of various type of the drain trough according to the invention, FIG. 4 is a sectional view of a kind of the drain trough when it is buried in earth, FIG. 5 shows a sectional view of a connector connecting plastic round pipes, and FIG. 6 is a sectional view of the round pipe and the connector fitted around the pipe.

DESCRIPTION OF THE PREFERRED EMBODIMENTS

Figure 1:
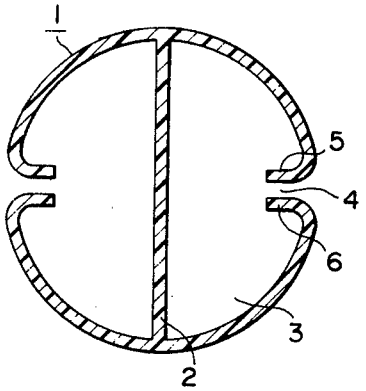
Figure 2:
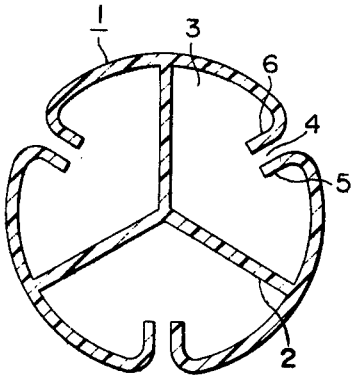
Figure 3:
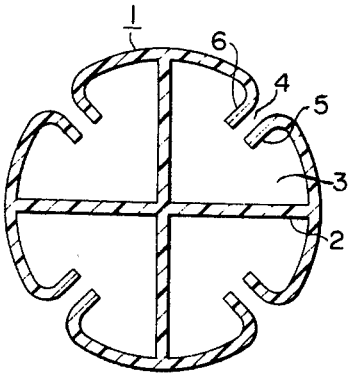

Referring to the drawings, various drain trough members 1 made of a round plastic pipe have various sectional shapes of a partition wall 2. According to the first embodiment of the invention, a partition wall of I-shape in section is used in the plastic round pipe. In the second and third embodiments, a Y-shaped partition wall and a cross-shaped partition wall are used in the pipe. As apparently shown in FIGS. 1, 2 and 3, the first embodiment of the drain trough has two compartments 3, the second drain trough has three compartments 3 and the third drain trough has four compartments. The partition wall is extended in the round pipe from a longitudinal end and another end of the pipe. Therefore, the compartments 3 respectively extend over the whole length of the pipe.

Each compartment formed in the pipe by the partition wall has slits 4 opening on the outer peripheral wall of the round pipe constituting the drain trough of the invention. The length of the slits 4 respectively are rather short and extend along the longitudinal direction. Preferably, all the slits formed on the circumference of the plastic round pipe are arranged on a straight line, so that it is said that the slit is intermittently formed and extends over the whole length of the pipe. The slits 4 respectively have two side edges extending along the longitudinal direction of the pipe or the drain trough. The side edges, 5, 6 each is bent inside of the pipe so as to form two long straps integrally attached to edges of the slits. The edges of a slit and the long straps formed along both the sides of the slit are connected by curved walls in order to easily flow water through the slit into the round pipe or the drain trough.

The plastic round pipes to be used to constitute the drain trough of the invention is easily and advantageously manufactured by extrusion molding of plastics. When the plastic extrusion molding process is carried out continuously, the length of the pipe is freely selected.

The plastic connector of the present invention is used to connect the round pipe members to each other and has a circular arc shape in section. The circumferential or curved of the circular arc of the connector is sodetermined as to fit firmly around the plastic pipes or members to be connected.

Figure 5:
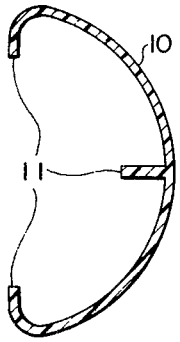
Figure 6:
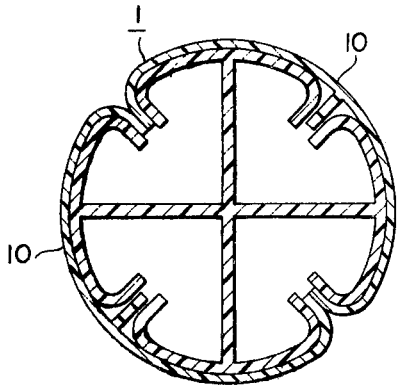

A connector 10 exemplarily shown in FIG. 5 is used to the round pipes each having four slits 4 formed on the peripheral wall of the round pipe as shown in FIG. 6.

As apparently shown in FIG. 5, the plastic connector 10 has two end ribs 11 and a central ribs 11. One or two connectors are used to connect the round pipes having four slits and accordingly four compartments 3. When two connectors 10 are used and oppositely fitted around the ends of the two pipes to ensure the connected condition of them, two ribs 11 of one connector 10 and another connector 10 are inserted into the slit 4.

Figure 4:
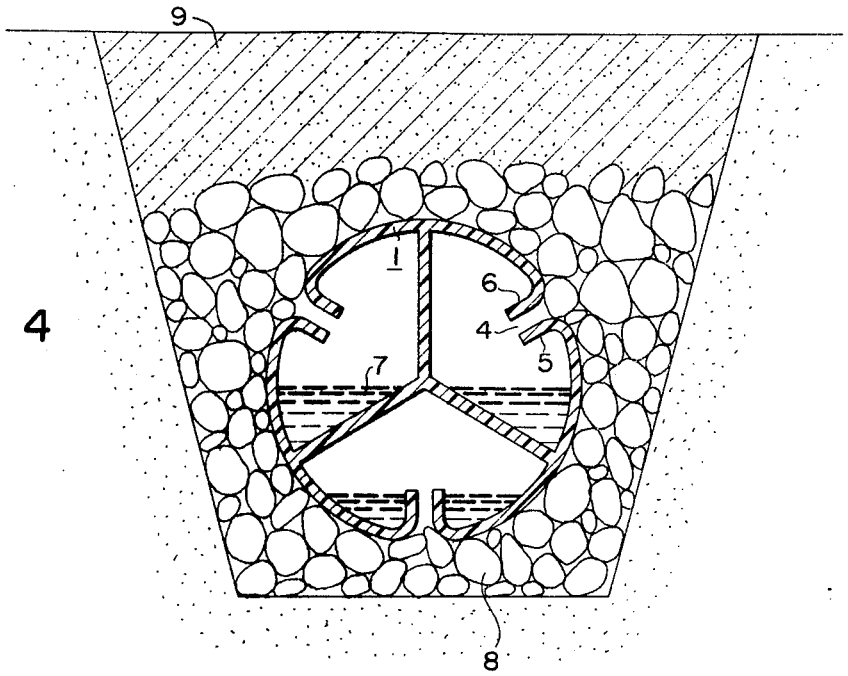

In construction of the drain trough of the invention, a groove 7 as shown in FIG. 4 a little wider than the outer diameter of the pipe is dug in the ground and coarse sand or small rocks 8 are paved on the bottom of the groove 7. Then a long drain trough of the round pipes and the connectors fitted around the pipes are positioned on the paved bottom and finally other sand and rocks are dumped into a remaining space of the groove. In order to finish the construction of the drain trough, earth and sand are placed on the rock and covers the pipes and the connectors. It is understood that the long drain trough is slantly placed in the ground so as to smoothly flow the water permeating the drain trough and connected by its end to a main water way.

The longitudinal length of the connector is determined so as to have the smallest length sufficient to efficiently accomplish the connecting function of the longitudinally arranged or lined pipes. As the ribs 11 of the connector are inserted into the slits 4 of the pipe, the pipe is prevented from collapsing due to an earth pressure applied to the pipe and accordingly the slits of the pipe are kept open. When the plastic pipes respectively are bent and connected by curved connectors, the drain trough of the pipe is buried under a curved road and concreted in earth of an arched edge of a tunnel.

As mentioned above, the partition wall of various shape is integrally formed in the inner space of the plastic pipe and so that when the drain trough is employed under highways for large-sized trucks, the pipe can not be broken and the drainage or water flows along the drain trough. Advantageously, as a plurality of slits 4 through which water flows in the pipe are employed, rainwater effectively enters through the slits and runs along the respective or separate compartments.

It is another feature of the invention that the drain trough can be buried irrespective of the opening direction of the slits, so that operators easily and effectively carry out the construction of the drain trough.

What is claimed is:

1. A drain trough comprising, a plurality of longitudinally arranged plastic round pipes, each pipe having a plurality of circumferentially spaced slits formed in an outer wall of the pipe and extending along a longitudinal direction of the pipe, and a plurality of plastic connectors of lesser longitudinal length than each of said pipes connecting next adjacent pipes and positioned circumferentially about circumferential portions of next adjacent pipes and each respectively having a cross-sectional shape of an arc of a circle and at least two ribs at the longitudinally extending ends of said connectors extending toward the center of the arc, each pipe having a partition wall within and extending continuously from an end of the pipe to its other end along a longitudinal direction of the pipe to divide in cross section an inside space of the pipe into several circumferentially spaced, longitudinally extending independent compartments, said partition wall having longitudinally extending portions integrally attached to inside wall portions of the plastic round pipe, each pipe additionally having longitudinally extending straps at the longitudinally extending edges of the slits extending inwardly of the pipe, wherein at least one connector is attached to the side walls of end portions of two pipes connected therewith, said ribs of the connector are firmly inserted into the slits, and the number of slits in a cross section of the outer wall of the pipe being equal to the number of the compartments formed in the pipe and communicating with a corresponding compartment.

* * * * *